United States Patent [19]

Kriechbaum et al.

[11] 4,390,764

[45] Jun. 28, 1983

[54] PUFFER-TYPE GAS BLAST SWITCH

[75] Inventors: Karl Kriechbaum, Kassel; Hans-Georg Augustin, Fuldabrück; Dietrich Hoffmann, Kassel-Ki, all of Fed. Rep. of Germany

[73] Assignee: Licentia Patent-Verwaltungs-G.m.b.H., Frankfurt am Main, Fed. Rep. of Germany

[21] Appl. No.: 146,403

[22] Filed: May 5, 1980

[30] Foreign Application Priority Data

May 5, 1979 [DE] Fed. Rep. of Germany ..... 2918145
Jan. 26, 1980 [DE] Fed. Rep. of Germany ..... 3002803

[51] Int. Cl.[3] ..... H01N 33/88

[52] U.S. Cl. ..... 200/148 A; 200/144 AP; 200/144 C

[58] Field of Search ..... 200/144 AP, 148 A, 144 C

[56] References Cited

U.S. PATENT DOCUMENTS

| | | | |
|---|---|---|---|
| 3,786,215 | 1/1974 | Mauthe | 200/148 A |
| 4,009,458 | 2/1977 | Kishi et al. | 200/144 AP |
| 4,211,904 | 7/1980 | Karrenbauer | 200/148 A |
| 4,221,942 | 9/1980 | Hertz et al. | 200/148 A |

FOREIGN PATENT DOCUMENTS

| | | | |
|---|---|---|---|
| 2336684 | 1/1975 | Fed. Rep. of Germany | 200/148 A |

*Primary Examiner*—Robert S. Macon
*Attorney, Agent, or Firm*—Spencer & Kaye

[57] ABSTRACT

In a puffer-type gas blast switch including a gas compression device composed of two components defining, respectively, a piston and a cylinder, one of the components being stationary and the other one of the components being movable for compressing a quenching gas in the chamber during switch opening, a nozzle mounted for directing the compressed quenching gas from the chamber against a switching arc, a first power contact fixed to the movable component of the gas compression device and movable between a switch closing position and a switch opening position, a second power contact arranged to be conductively connected to the first power contact when the latter is in its switch closing position and movable with the latter during at least the initial portion of its movement from the switch closing position, and spring means urging the second contact in a direction to break its connection with the first contact, the second contact is directly and releasably connected to the first contact when the first contact is in its switch closing position, and the switch further includes an abutment member for limiting the path of movement of the second contact with the first contact during movement of the first contact to its switch opening position.

26 Claims, 12 Drawing Figures

FIG.5
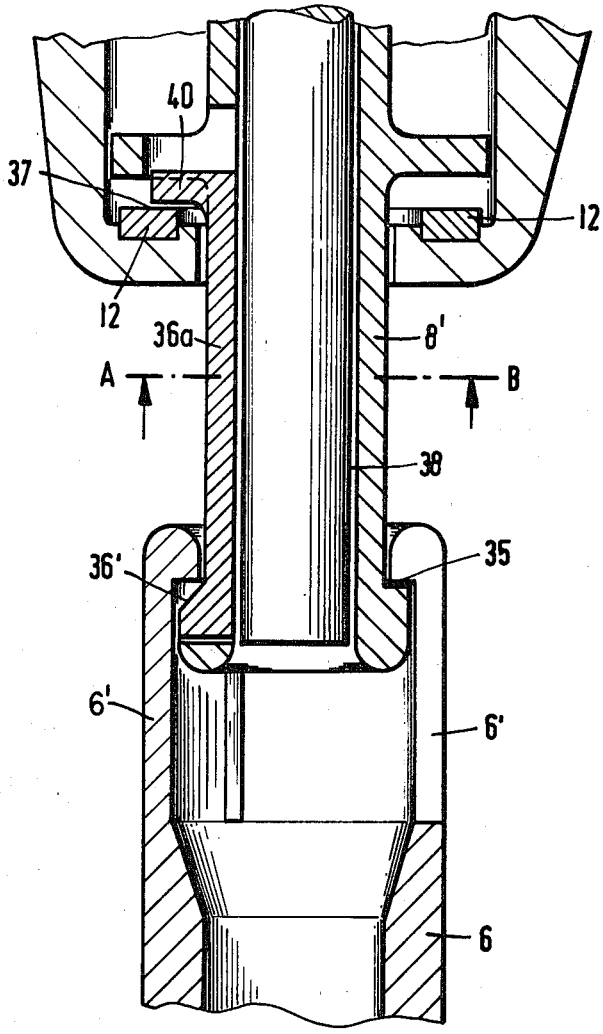
FIG.6 (A-B)
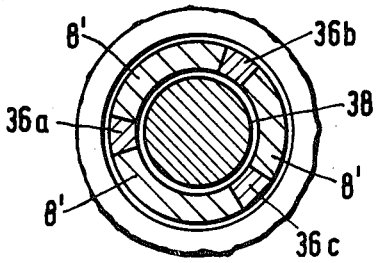

PUFFER-TYPE GAS BLAST SWITCH

BACKGROUND OF THE INVENTION

The present invention relates to a puffer-type gas blast switch as defined in the preamble of claim 1.

Puffer-type gas blast switches with insulating nozzles have relatively long arc periods because at the time the contact is severed there is present a comparatively low gas pressure which is not yet sufficient to quench strong arc currents. A sufficiently high pressure builds up only after the switch has passed through a larger stroke. In such switches there essentially exist the following drawbacks: the arc is drawn out, it burns a long time, and quenching gas is wasted at a time when there is as yet no chance of quenching. The energy consumption in the switching path becomes high as a result of these influences and either limits the circuit breaking capability of such switches or necessitates comparatively large quenching chambers so as to avoid undue pressure increases.

Puffer-type switches are known in which the contact piece which is actuated by the switch drive as well as the counter contact piece are movable. In such switches the counter contact piece is controlled by the movement of a piston. However, such switches are costly and complicated and can therefore not be used in an atmosphere containing $SF_6$ dissociation products, as disclosed in German Offenlegungsschrift No. 2,100,808.

German Offenlegungsschrift No. 2,708,546, and corresponding U.S. application Ser. No. 881,719, filed Feb. 27th, 1978, now U.S, Pat. No. 4,211,904, issued July 8th, 1980, also discloses a puffer-type gas blast circuit breaker in which a switching contact disposed in an insulating nozzle is mounted to be axially displaceable in a guide actuated by a pull rod. In the on-state, the switching contact disposed in the insulating nozzle is latched in a stationary counter contact. For breaking the circuit, the guide, the insulating nozzle and cylinder connected with these parts are moved in the OFF direction. Due to the latching, the contact disposed in the insulating sleeve is pulled out of the guide whereby an annular projection of the switching contact abuts against the upper edge of the guide. At this moment, the switching contacts are pulled apart and the contact that has been pulled out of the guide is accelerated by the compression spring to spring back into the guide, or the insulating nozzle, respectively.

Although with such a gas blast switch the arc period can be shortened and blasting of the arc before reaching the quenching distance can be prevented, a correspondingly large stroke is required to attain a sufficiently high pressure in the cylinder, causing the contact to be pulled out by a corresponding amount. This makes it impossible to maintain the optimum quenching distance.

SUMMARY OF THE INVENTION

It is an object of the present invention to overcome the drawbacks present in such prior art switches.

This and other objects are accomplished, according to the present invention, in a puffer-type gas blast switch including a gas compression device composed of two components defining, respectively, a piston and a cylinder, one of the components being stationary and the other one of the components being movable for compressing a quenching gas in the chamber during switch opening, a nozzle mounted for directing the compressed quenching gas from the chamber against a switching arc, a first power contact fixed to the movable component of the gas compression device and movable between a switch closing position and a switch opening position, a second power contact arranged to be conductively connected to the first power contact when the latter is in its switch closing position and movable with the latter during at least the initial portion of its movement from the switch closing position, and spring means urging the second contact in a direction to break its connection with the first contact, by constructing the second contact to be directly and releasably connected to the first contact when the first contact is in its switch closing position, and further providing the switch with abutment means for limiting the path of movement of the second contact with the first contact during movement of the first contact to its switch opening position.

This solution provides a puffer-type switch offering the following features and advantages:

1. quenching can take place in an optimum range;
2. short arcs and short arcing periods;
3. low quenching gas losses at a time when there is no chance for quenching;
4. particularly simple design of the switch.

Various embodiments of the invention provide, inter alia, the following further advantages:

5. particularly small minimum arcing periods since the second contact is moved back at approximately the same speed with which it hits the abutment; this permits the use of very high breaking speeds so that it becomes possible to use only few switching paths, e.g. two switching paths for 525 kV even at an operating frequency of 60 Hz. without interfering the re-ignition freedom of the switch;
6. even high short-circuit currents can be switched to advantage;
7. the contact disposed in the insulating nozzle, which is under the greatest stress, can be made very stable;
8. the advantages of the gas blast switch can be utilized in connection with a resistance switching path;
9. the lagging masses of the second contact are reduced;
10. there is little thermal influence on the latching since the conical undercut of the contact piece is sheltered from the plasma stream;
11. substantial changes in the latching forces due to partial burning away of the conical contact faces is prevented;
12. force locking oblique latching faces arranged at a certain angle are avoided, or replaced, by force locking latching faces which are arranged at a right angle to the axis of movement. The unlatching process is thus no longer produced in dependence on the forces acting on the latching but independently of position by means of a separate spreading device which during a switch-off movement temporarily impinges on its own abutment shortly before the impingement of the second contact piece and spreads the first contact piece via a previously unstressed oblique face to unlatch it. The position and width of this oblique face are necessarily dimensioned in such a manner that the first contact piece has already been spread before the second contact piece is braked by the abutment. Due to the form-locking connection on the one hand and the position dependent unlatching on the other hand, the motion sequence realized is essentially independent of the wear of the components. Changes in the contact conditions due to wear of the contact faces of the latching system are excluded during the unlatching process, when the edges of the latch are subjected to high specific areal pressures. Moreover these parts simultaneously transmit, for a brief time, the full current of the switching path;

13. Burning away of regions of the contact area required for latching is prevented; and
14. it is assured that the arc does not attack the conical face so that the arc remains better suited for the latching function although the contact carries a plasma stream.

FIGS. *3a* to *3e* are schematic illustrations of successive stages in the switch-on and switch-off process of a gas blast switch according to the invention in conjunction with a parallel switching contact for switching in a switch-on resistor.

Figure 4:
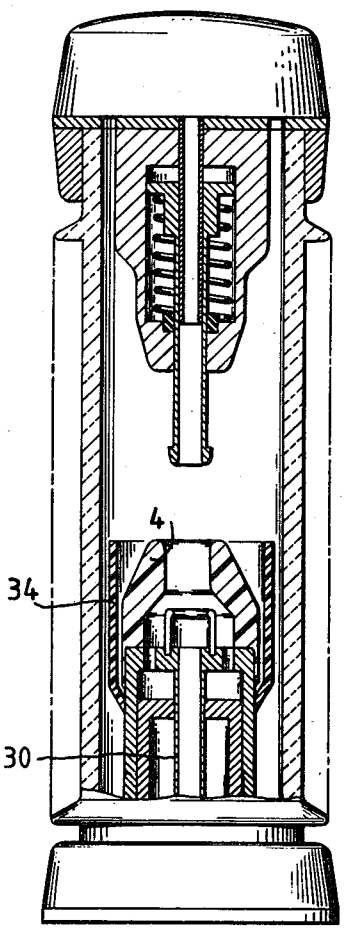
Figure 1:
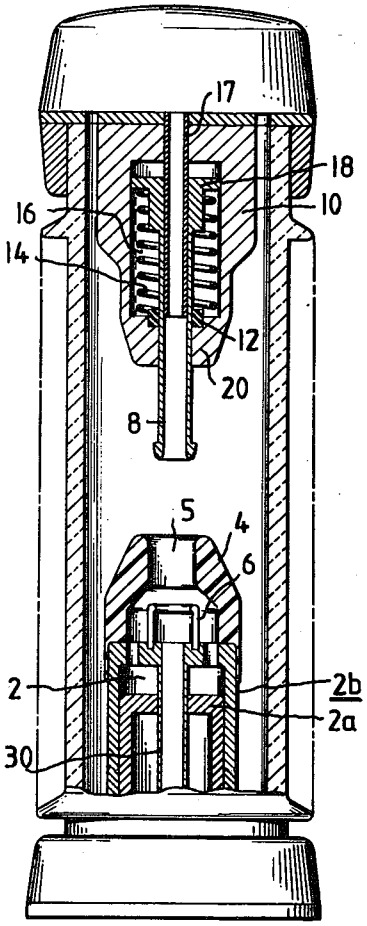
FIG. 1 is an elevational, cross-sectional view of a preferred embodiment of a puffer-type gas blast switch according to the invention, in the open, or off position.
Figure 3A:
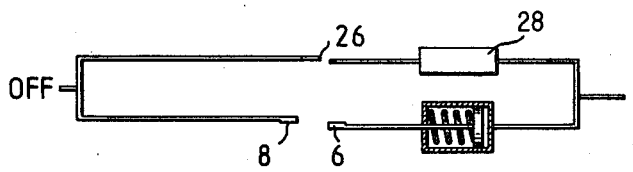
Figure 3B:
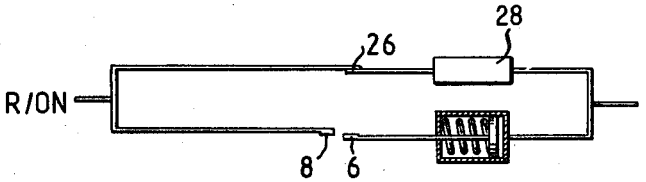
Figure 3C:
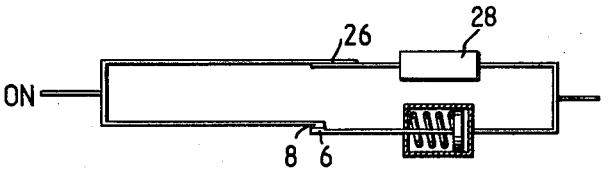
Figure 3D:
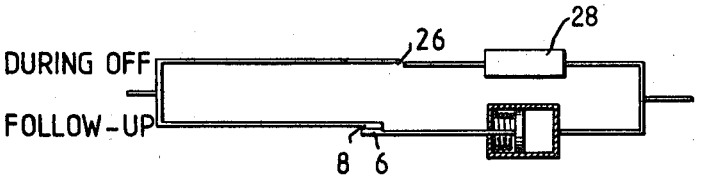
Figure 3E:
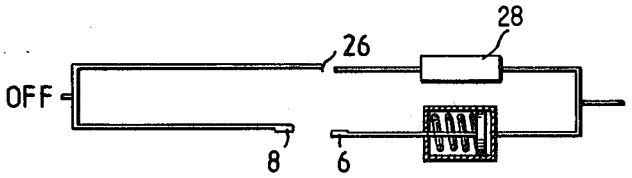

FIG. 4 is a view similar to that of FIG. 1 of a further embodiment of the invention in which the insulating nozzle is enclosed by a metallic shield.

FIG. 5 is a cross-sectional detail view of another embodiment of a contact system of a gas blast switch according to the invention provided with a spreading device.

FIG. 6 is a sectional view along line A-B of FIG. 5.

Figure 7:
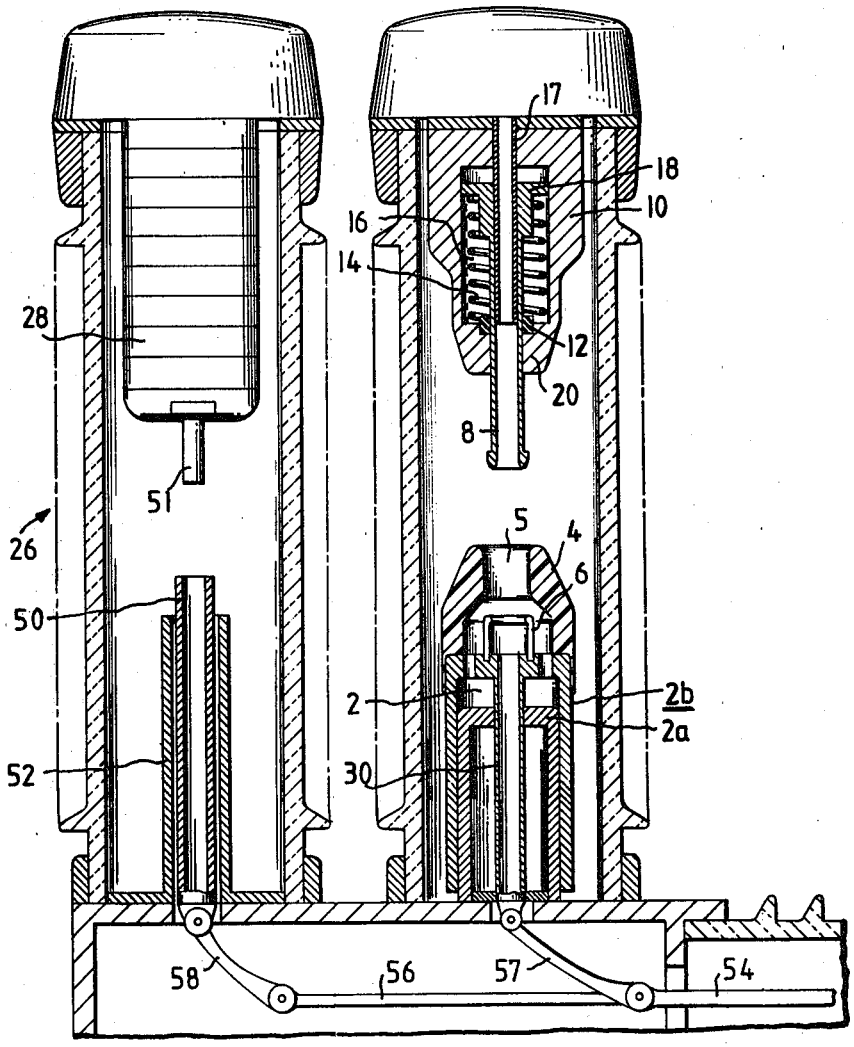

FIG. 7 is a cross-sectional view of a preferred embodiment of a puffer-type gas blast switch combined with a switch for switching a conductive path containing a switch-on resistor.

Figure 8:
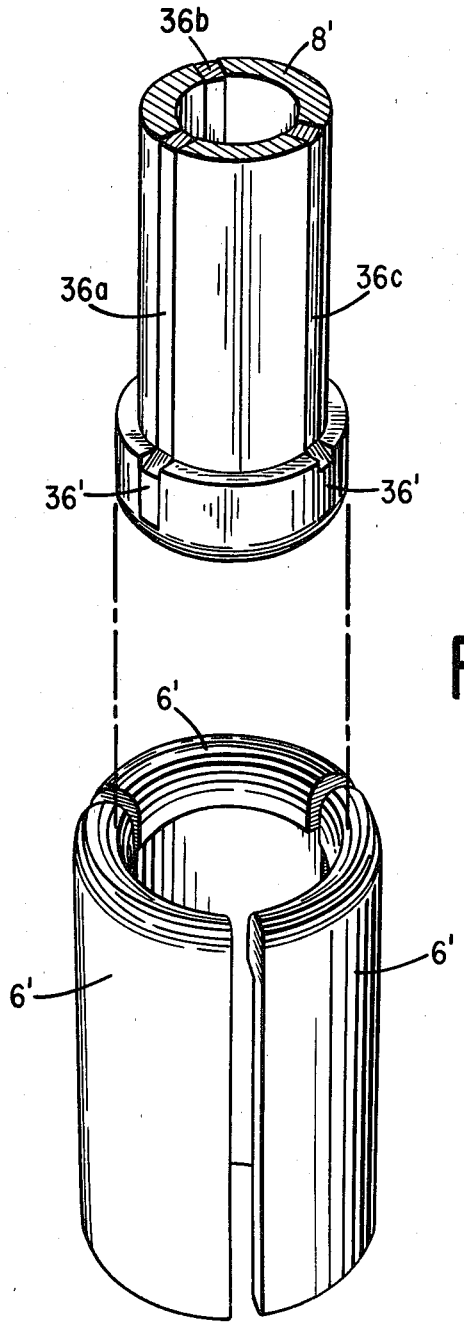

FIG. 8 is a perspective detail view of a portion of the structure of FIGS. 5 and 6 with the contact pieces separated.

DESCRIPTION OF THE PREFERRED EMBODIMENTS

The gas blast switch shown in FIG. 1 is essentially composed of the following parts pertaining to its contact system: a gas compression chamber 2 defined by a stationary piston *2a* and a movable cylinder *2b*; a nozzle 4 made of an electrically insulating and heat resistant material attached to the cylinder *2b*; a movable power contact piece 6 provided in the insulating nozzle and movable therewith; a movable power contact piece 8 disposed to be axially displaceable on a slide-tube 17 mounted in the upper portion 10 of the switch. The contact piece 8 forms a counter contact for piece 6. The switch further includes an abutment member 12 and a compression spring 14.

Figure 2:
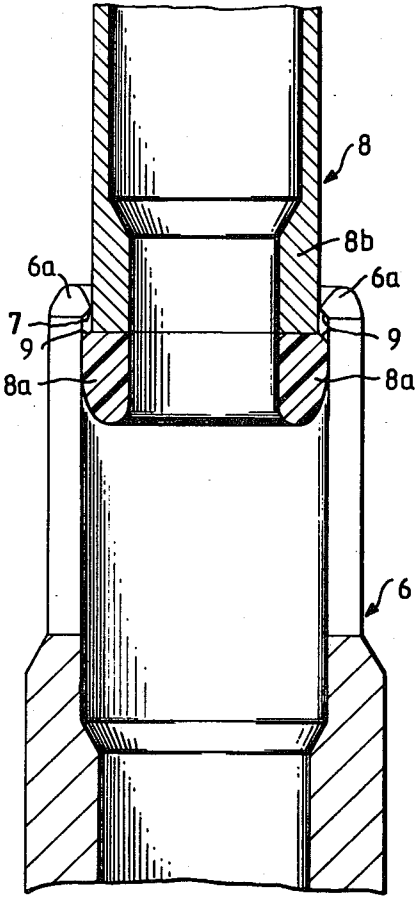
FIG. 2 is a cross-sectional detail view showing the contact-engaging region of the switch of FIG. 2 with the switch in its closed, or on, position.

The contact piece 6 disposed in the insulating nozzle 4 is provided at its front end with a conical undercut 7 which can be seen more clearly in FIG. 2. Correspondingly the front end of the counter contact piece 8 is provided with a conical protrusion 9 which latches with the undercut portion 7.

The counter contact piece 8 is arranged to be axially displaceable in a cylindrical recess 16 in the upper portion 10 and includes an upper flange 18 against which the upper end of compression spring 14 rests.

The abutment 12 is disposed in a mount 20 carried by portion 10 and delimiting the lower end of recess 16. This abutment 12 may be made resilient so that the counter contact piece 8 will be driven away from contact piece 6 at approximately the same speed as it impacts on abutment 12. This makes it possible to realize very minimal arc periods.

However, the abutment 12 may also be made to produce a mechanical damping action on piece 8 which is of particular advantage if high currents have to be switched.

FIG. 2 shows the contact pieces 6 and 8 in the latched state. In order to permit unlatching of the contact pieces, longitudinal slots (not shown) are advantageously provided in the counter contact piece 8 so as to permit lateral deformation of piece 8. However, as shown in FIG. 2, the contact piece 6 disposed in the insulating nozzle may be provided with slots, either in addition or alternatively to piece 8.

Starting with the switched-on position of the switch, in which the contact pieces are latched as shown in FIG. 2, contact 8 is in the position shown in FIG. 1, and nozzle 4 fits around piece 8 the switch-off process takes place as follows. A switching rod 30 actuated by a drive (not shown) moves the contact piece 6 as well as the cylinder *2b* connected therewith and the insulating nozzle 4 downwardly so that quenching gas disposed in chamber 2 is compressed. In the initial phase, the nozzle opening is closed by the contact piece 8. During the downward movement, the contact pieces 6 and 8 initially remain latched together, i.e. the counter contact piece 8 follows the movable contact piece 6, thus compressing the spring 14.

Unlatching occurs when the countercontact piece 8 impacts on the abutment 12, whereupon the contact pieces 6 and 8 are pulled apart and the countercontact piece 8 then jumps back, under the action of spring 14, into the end position shown in FIG. 1. This unblocks the nozzle opening 5 and the blasting of gas onto the arc begins.

FIGS. 3 are schematic illustrations of the design of a switch including a switch-on resistor 28.*) During switch-on, starting from the off position shown in FIG. *3a*, approximately 8 to 10 ms before the main switching path is closed the resistance switching path 26 is closed as shown in FIG. *3b*, and remains closed after completion of the switch-on of the main path, as shown in FIG. *3c*. During switch-off both contact pieces move in the OFF direction. Because the main contact initially carries along the movable contact, the resistance switching path 26 opens first, as shown in FIG. *3d*, after which the fully open state depicted in FIG. *3e* is reached. Therefore, this arrangement does not require a complicated sliding or spring lock.

*) The form of this switch is described in connection with FIG. 7.

A corresponding arrangement is shown in FIG. 7. The gas blast switch shown in FIG. 7 corresponds partly the switch shown in FIG. 1. The corresponding parts have equal numbers. The gas blast switch of FIG. 7 has an additional switch or connector 26 for switching a conductive path containing a switch-on resistor 28.

The switch 26 is essentially composed of a movable contact piece 50 and a counter contact piece 51. The movable contact piece 50 is a tube which is arranged axially displaceable in a cylindriacal part 52 and which is engageable with the counter contact piece, which is conductive connected with the resistor 28. The switch 26 with the resistor 28 and the gas blast swich are connected parallel as it is shown in FIGS. *3a–3e*. The movable contact pieces 6 and 50 of the switches are actuated by an actuation rod 54 and hinged levers 56, 57, 58. The operation of the switch shown in FIG. 7 is described in connection with FIG. 3.

In the embodiment shown in FIG. 4, the insulating nozzle 4 is enclosed by a metallic shield 34 which serves to shield the contact piece disposed in the insulating nozzle against flashovers from contact piece 8.

The contact system shown in FIGS. 5, 6 and 8 includes, as does the system shown in FIGS. 1 to 4, a first contact piece 6 which is firmly connected with the movable part of a piston/cylinder unit (not shown here) of a compression device for the quenching gas, and a counter contact piece 8 which during switch-off is initially kept in engagement with the first contact piece 6 and moves therewith until unlatching, piece 8 then returning to its starting position under spring pressure. The counter contact piece 8 is again directly and releasably connected with the first contact piece 6 and the following movement of contact piece 8 is again limited by abutment 12.

A positive, form-locking connection is provided between the two contact pieces 6 and 8, in that the two pieces are provided with mating contact faces 35 which lie at a right angle to the axis of movement so that pieces 6 and 8 are interlocked to establish a force transmitting connection therebetween.

For unlatching the contact pieces 6 and 8, a spreading device 36 is provided which is connected with the counter contact piece 8 and comes up against an abutment 37 shortly before the counter contact piece 8 reaches its abutment position, thus initiating unlatching of the two contact pieces 6 and 8.

FIG. 8 shows these contact pieces when they are unlatched, i.e. when the switch is open.

The spreading device 36 includes, as shown in FIGS. 5 and 8, a conical camming surface 36' over which the end of contact piece 6 travels during braking of the spreading device when the spreading device impinges on its abutment 37, thus spreading all of its contact fingers 6' in radial direction. The radial height and axial position of surface 36' are here selected such that they correspond to the unlatching stroke of the unlatching device. Thus, during a switch-off movement the unlatching stroke is performed before the counter contact piece 8 impinges on its abutment 12.

In an advantageous manner, as shown in FIG. 6, the spreading device 36 includes two or more fingers 36*a, b, c,* which fit into corresponding recesses between portions 8', of the substantially tubular counter contact piece 8 and which are connected with a ring 40 or sections of a ring, which during the switch-off movement comes up against abutment 37 which limits the stroke of the spreading device. Preferably, piece 6 is provided with a number of fingers 6' equal to the number of fingers 36*a, b,* etc., with each of the latter fingers engaging a respective finger 6'.

As a protection for the gaps between the spreading device 36 and the counter contact piece 8 against soiling from combustion particles or as a protection for the parts themselves against the wear to be expected from the arc during switch-off, a protective tube 38 of fireproof material is disposed in the interior of the arrangement and is connected with the counter contact piece 8.

In practical devices according to the invention, the spreading device 36 can be made of a hard resilient metal such as steel or titanium, or may be made entirely of a suitable plastic. When device 36 is made of metal, the slide faces thereof which act on contact 6 can be covered or coated with a low friction plastic, such as Teflon. The portions (FIG. 2) 6*a,* 8*a* of contacts 6 and 8 which contact one another can be made of a suitable fireproof material. The contact 6, or the portions thereof in the region where connection is effected with contact 8, can be made of copper or a suitable copper alloy e. g. chromium-copper. The parts 8*b* of the contact 8 which do not conduct current are made of titanium.

A suitable resilient abutment 12 is a cup spring; a suitable material for the movement damping body is polyurethan. The inclination angle of the conically tapered surfaces is in the range of 15°–20° relative to a line perpendicular to the longitudinal axe of the switch pieces. When the surfaces have different inclinations, the inclination angle of the contact piece 8 is in the range 13°–18°. Suitable plastic materials for the spreading device are Teflon or Delrin. The fireproof materials for the contacts and the protective tube can be copper-tungsten-alloy or graphite. The metallic shield 34 material can be copper.

It is to be understood that the above description of the present invention is susceptible to various modifications, changes and adaptations, and the same are intended to be comprehended within the meaning and range of equivalents of the appended claims.

What is claimed is:

1. A puffer-type gas blast switch comprising a gas compression device composed of two components constituting, respectively, a piston and a cylinder between which is defined a gas compression chamber, one of the components being stationary and the other one of the components being movable for compressing a quenching gas in the chamber during switch opening, an insulating nozzle mounted for directing the compressing quenching gas from the chamber against a switching arc, a first power contact fixed to the movable component of the gas compression device and movable between a switch closing position and a switch opening position, a second power contact arranged to be conductively connected to the first power contact when the latter is in its switch closing position and movable with the latter during at least the initial portion of its movement from the switch closing position, stationary means supporting said second contact, spring means urging the second contact in a direction to break its connection with the first contact, said second contact being directly and releasably connected to said first contact when said first contact is in its switch closing position, and abutment means for limiting the path of movement of said second contact with said first contact during movement of said first contact to its switch opening position.

2. A switch as defined in claim 1 wherein said piston is said stationary component and said cylinder is said movable component, and said nozzle is attached to said cylinder and surrounds said first contact.

3. A switch as defined in claim 1 or 2 wherein said contacts are provided with latches engageable with one another for maintaining said contacts in mutual engagement until said second contact engages said abutment means as said first contact moves toward its switch opening position.

4. A switch as defined in claim 3 wherein said abutment means is constituted by a resilient body.

5. A switch as defined in claim 3 wherein said abutment means is constituted by a movement damping body.

6. A switch as defined in claim 3 wherein said latches are constituted by conically tapered surfaces on lateral faces of said contacts which engage one another when said contacts are connected together, said surfaces being oriented to engage one another in a manner to tend to hold said contacts in engagement.

7. A switch as defined in claim 6 wherein said tapered surfaces on said two contacts present respectively different inclinations.

8. A switch as defined in claim 1 wherein said second contact is axially slotted at the end thereof facing said first contact.

9. A switch as defined in claim 1 further comprising a parallel contact for switching a conductive path containing a switch-on resistance.

10. A switch as defined in claim 1 wherein the parts of said second contact which do not conduct current are made of titanium.

11. A switch as defined in claim 1 further comprising a metallic shield enclosed said nozzle.

12. A switch as defined in claim 1 further comprising latch means for establishing a form-locking connection between said contacts when they are conductively connected together, said latch means being formed by connecting surfaces unitary with said contacts, extending at right angles to the direction of movement of said first contact between its switch closing and switch opening positions, and positioned to engage one another in a force transmitting manner during movement of said first contact from its switch closing position to its switch opening position, and said latch means additionally comprising: a spreading device associated with said second contact and arranged to separate said connecting surfaces of said contacts to release the connection therebetween; and second abutment means disposed to cooperate with said spreading device for stopping said spreading device and causing it to separate said connecting surfaces before said first contact reaches the end of movement to its switch opening position and before said second engages said first-recited abutment means.

13. A switch as defined in claim 12 wherein said first contact comprises a plurality of flexible contact fingers extending in the direction of its movement between the contact closing and contact opening positions, and each carrying a respective connecting surface, and said spreading device presents a conical camming surface which engages said contact fingers after said spreading device encounters said second abutment means to thereby deflect said fingers laterally of the direction of movement of said first contact out of engagement with said connecting surface of said second contact.

14. A switch as defined in claim 13 wherein the dimension of said conical camming surface in the direction of movement of said first contact between its switch closing and switch opening positions is at least equal to the path of movement of said second contact from the point where said spreading device is stopped by said second abutment means to the point where movement of said second contact is halted by said first-recited abutment means, and said conical camming surface is located to deflect said contact fingers of said first contact out of engagement with said second contact before said second contact is halted by said first-recited abutment means.

15. A switch as defined in claim 12 wherein said second contact is a tubular member extending in the direction of movement of said first contact and presenting a plurality of axially extending, circumferentially spaced recesses, and said spreading device comprises a plurality of fingers located in said recesses and a ring member connecting said fingers together and positioned to cooperate with said second abutment means.

16. A switch as defined in claim 12 wherein said second abutment means is constituted by a resilient body.

17. A switch as defined in claim 12 wherein said second abutment means is constituted by a movement damping body.

18. A switch as defined in claim 12 wherein said spreading device is made of a hard, resilient metal.

19. A switch as defined in claim 18 wherein the hard metal of said spreading device is steel or titanium.

20. A switch as defined in claim 12 wherein the faces of said spreading device which contact said first contact are covered with a low-friction plastic.

21. A switch as defined in claim 20 wherein the plastic is Teflon.

22. A switch as defined in claim 12 wherein said spreading device consists entirely of plastic.

23. A switch as defined in claim 12 wherein said second contact is a hollow tubular member extending in the direction of movement of said first contact between its switch closing and switch opening positions, and further comprising a protective tube of fireproof material located within, and secured to, said second contact for protecting said second contact and said spreading device against soiling by arc combustion particles and against erosion by the arc produced during switch opening.

24. A switch as defined in claim 12 wherein said first-recited abutment means and said second abutment are together constituted by a single member.

25. A switch as defined in claim 1 wherein said contacts are made of a fireproof material in the region where they contact one another.

26. A switch as defined in claim 1 wherein said first contact piece is enclosed by said insulating nozzle and consists, in the region where it contacts said second contact, of copper or a copper alloy.

* * * * *